US011555354B2

(12) United States Patent
Hansen et al.

(10) Patent No.: US 11,555,354 B2
(45) Date of Patent: Jan. 17, 2023

(54) METHOD AND APPARATUS FOR SEALING A SIDE POCKET MANDREL

(71) Applicant: Aarbakke Innovation AS, Bryne (NO)

(72) Inventors: Henning Hansen, Sirevåg (NO); Reid Skjaerpe, Naerbo (NO)

(73) Assignee: Aarbakke Innovation AS, Bryne (NO)

( * ) Notice: Subject to any disclaimer, the term of this patent is extended or adjusted under 35 U.S.C. 154(b) by 181 days.

(21) Appl. No.: 17/150,207

(22) Filed: Jan. 15, 2021

(65) Prior Publication Data

US 2021/0140246 A1 May 13, 2021

Related U.S. Application Data

(63) Continuation of application No. PCT/IB2019/055124, filed on Jun. 19, 2019.

(60) Provisional application No. 62/698,404, filed on Jul. 16, 2018.

(51) Int. Cl.

| | |
|---|---|
| ***E21B 17/02*** | (2006.01) |
| ***E21B 23/03*** | (2006.01) |
| ***E21B 33/12*** | (2006.01) |
| *E21B 43/12* | (2006.01) |

(52) U.S. Cl.

CPC ..... *E21B 17/025* (2013.01); *E21B 23/03* (2013.01); *E21B 33/12* (2013.01); *E21B 43/123* (2013.01)

(58) Field of Classification Search

CPC ..... E21B 17/025; E21B 23/03; E21B 33/12; E21B 43/123; E21B 33/13; E21B 43/122

See application file for complete search history.

(56) References Cited

U.S. PATENT DOCUMENTS

| | | | | |
|---|---|---|---|---|
| 4,524,833 | A * | 6/1985 | Hilts | E21B 23/03 166/381 |
| 7,823,649 | B2 * | 11/2010 | Brown | E21B 33/13 166/386 |
| 11,053,773 | B2 * | 7/2021 | Beach | E21B 27/02 |
| 2009/0250227 | A1 * | 10/2009 | Brown | E21B 33/10 166/386 |
| 2009/0301720 | A1 * | 12/2009 | Edwards | E21B 33/146 166/120 |

(Continued)

FOREIGN PATENT DOCUMENTS

| | | | |
|---|---|---|---|
| GB | 2518683 | A | 4/2015 |
| WO | 2018/115053 | A1 | 6/2018 |

OTHER PUBLICATIONS

United Kingdom Examination Report dated Feb. 23, 2022, United Kingdom Patent Application No. GB2101987.2.

(Continued)

*Primary Examiner* — Steven A MacDonald
(74) *Attorney, Agent, or Firm* — Richard A. Fagin

(57) ABSTRACT

A method for sealing a side pocket mandrel and hydraulic tube includes moving a sealant dispenser into a pocket of the side pocket mandrel from within a well tubing. The sealant dispenser has an upper seal and a lower seal spaced apart therefrom; the seals are sealingly engaged with the pocket. A space between the upper seal and the lower seal is in fluid communication with at least one port in the pocket. A curable sealant is moved from the sealant dispenser into the pocket and into the tube. Either the sealant is allowed to cure or the sealant dispenser is unlatched from a running tool used to move the sealant dispenser into the pocket.

8 Claims, 1 Drawing Sheet

(56) References Cited

U.S. PATENT DOCUMENTS

| | | | | |
|---|---|---|---|---|
| 2010/0078171 | A1* | 4/2010 | Moody | E21B 49/10 166/298 |
| 2010/0122819 | A1* | 5/2010 | Wildman | E21B 43/123 166/117.6 |
| 2013/0312963 | A1* | 11/2013 | Larsen | E21B 43/114 166/376 |
| 2014/0318782 | A1* | 10/2014 | Bourque | E21B 27/02 166/177.4 |
| 2016/0208569 | A1* | 7/2016 | Anderson | E21B 33/1208 |
| 2017/0009554 | A1 | 1/2017 | Surjaatmadja | |
| 2019/0169955 | A1* | 6/2019 | Knight | E21B 37/045 |
| 2019/0178051 | A1* | 6/2019 | Beach | C09K 8/04 |

OTHER PUBLICATIONS

United Kingdom Examination Report Letter dated Feb. 23, 2022, United Kingdom Patent Application No. GB2101987.2.

International Search Report and Written Opinion, International Application No. PCT/IB2019/055124 dated Sep. 18, 2019.

* cited by examiner

METHOD AND APPARATUS FOR SEALING A SIDE POCKET MANDREL

CROSS REFERENCE TO RELATED APPLICATIONS

Continuation of International Application No. PCT/IB2019/055124 filed on Jun. 19, 2019. Priority is claimed from U.S. Provisional Application No. 62/698,404 filed on Jul. 16, 2018. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of tools used in connection with tubular strings in subsurface wells. More particularly, the disclosure relates to tools and methods for closing external flow lines connected to such tubular strings.

Subsurface wells used for extraction of fluids from subsurface reservoir formations may comprise a tubular string ("pipe string") such as a casing or liner extending through such a reservoir, which pipe string may be permanently emplaced such as by cementing. Additional tubular strings may be nested within such casing or liner, for example a tubing string. Such nested tubular string may have an internal diameter chosen to provide increased velocity to fluids moving to the surface so that dense fluids such as water and solid particles produced from the reservoir may be entrained in the fluid flow to the surface. It is known in the art when a well has reached the end of its productive lifetime, such well may be sealed closed. Permanently leaving well completion strings and components in a well when abandoning the well has substantial cost and environmental savings potential.

So-called side pocket mandrels are well known to be used in casings, and more typically in tubing strings. Side pocket mandrels are disposed in the pipe string at selected locations along the length of the pipe string and are coupled to one or more hydraulic tubes extending from the surface or from a seabed located wellhead. Gas or chemicals may be pumped through such tube(s) into the side pocket mandrel(s). The side pocket mandrels may contain devices such as wireline retrievable gas lift valves or chemical injection valves. From this valve, the gas or chemicals are released into the moving fluid stream. The fluid stream is thereby treated with suitable chemicals and/or is made less dense to as to be able to reach the upper end of the well by gravity.

In abandoning a well with side pocket mandrels so as to leave them in place in a well, there is risk that leaks may occur at any point along the hydraulic tube to the surface. It is desirable in abandonment procedures to eliminate the risk of such leaks. The foregoing may be performed by injecting a sealant into the hydraulic tube, however experience has shown that it is very difficult to pump such sealants all the way from the surface or subsea wellhead down to a side pocket mandrel.

SUMMARY

A method for sealing a side pocket mandrel and hydraulic tube according to one aspect of the disclosure includes moving a sealant dispenser into a pocket of the side pocket mandrel from within a well tubing. The sealant dispenser has an upper seal sealingly engaged with the pocket. A curable sealant is moved from the sealant dispenser into the pocket and into the tube. Either the sealant is allowed to cure or the dispenser is unlatched from a running tool used to move the dispenser into the pocket.

Some embodiments further comprise removing the dispenser and the running tool from the well.

In some embodiments, the removing the dispenser comprises withdrawing a wireline conveyed kickoff tool and running tool from the well.

In some embodiments the moving the dispenser comprises lowering a wireline conveyed kickoff tool and running tool into the well.

In some embodiments, the pocket is in fluid communication with a tube disposed externally to the side pocket mandrel and the tubing. In such embodiments, the dispenser may comprise a lower seal section longitudinally spaced apart from the upper seal section to define a portion in fluid communication with at least one port in the pocket.

DETAILED DESCRIPTION

Figure 1:
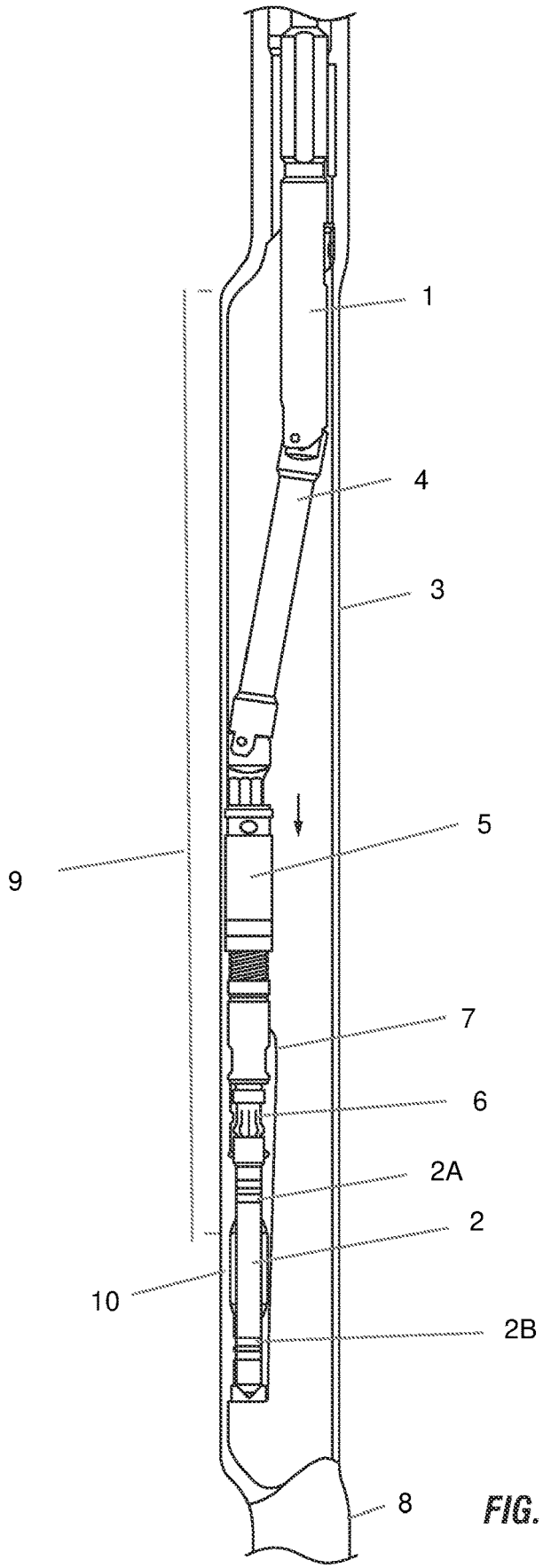
FIG. 1 shows an example embodiment of a wireline kick over tool with a sealant dispenser in the form of a wireline replaceable valve inserted into a side pocket mandrel in a wellbore.

In embodiments of a method according to the present disclosure, a wireline kickover tool may be coupled to a tool module that has therein a sealant dispenser such as a pump or release mechanism, and in the lower end of the tool a ported spacer such as a modified wireline replaceable gas lift valve or chemical injection valve (the "valve"). A lock, or latch, is removed from the valve. A sealant material disposed within the pump or release module coupled to the kickover tool can be released or pumped through the kickover tool, the kickover tool arm, a spacer tube and the valve, and thereby into the side pocket mandrel. In other embodiments, the sealant dispenser may be disposed in or next to the valve or substitute for the valve. In such embodiments, the sealant may be released from or pumped through the valve into the side pocket mandrel.

The operator may deploy the wireline kickover tool into the well and engage the side pocket mandrel as is ordinarily performed for installing a gas lift or chemical injection valve into the side pocket mandrel. When the valve or dispenser has landed into the side pocket mandrel, with valve seals positioned above and below a discharge port for the gas or chemicals from the surface, the operator starts the pumping or release of the sealant which will then flow into the side pocket mandrel and subsequently into hydraulic tube connected to the mandrel. Prior to the start of sealant release or pumping, it is expected that the hydraulic tube will be open at the subsurface wellhead or at surface so that a hydraulic lock does not take place while introducing sealant from the kickover tool.

Following injection or release of an appropriate amount of sealant, the kickover tool and (dispenser) valve may be held in place until the sealant has cured. Thereafter the operator may retrieve the valve (dispenser) and kickover tool from the well. In some embodiments, the valve can be released from the kickover tool and left in the side pocket mandrel, preventing sealant from draining back from the hydraulic tube prior to cure. The foregoing procedure may save time, as the operator does not need to wait for the sealant to cure.

Having explained a method according to the present disclosure, an apparatus that may be used to carry out such a method will be explained with reference to FIG. 1, which shows a typical wireline kickover tool (1) with a sealant dispenser (2) ("dispenser") which may be a modified wireline replaceable valve inserted into a side pocket mandrel (3). The dispenser (2) may comprise a pump and/or sealant reservoir (not shown separately) that may contain and be used to release a sealant, e.g., cement, epoxy or any other suitable pressure-tight, curable sealing material into the side pocket mandrel (3) as further explained below. In some embodiments, a sealant reservoir and pump may be disposed in the running tool (5), the kickover tool (1) or elsewhere in the assembly of downhole tools. In such embodiments, the dispenser (2) may comprise a valve that may remain in place in the side pocket mandrel (3) after sealant has been dispensed and the remainder of the downhole tool assembly is removed from the well.

The kickover tool (1) comprises a kickover arm (4) used to guide a wireline pulling or running tool (5) into the side pocket (7) of the side pocket mandrel (3). The wireline pulling or running tool (5) latches onto a latch or lock (6) which is mounted on top of the dispenser (2), where the dispenser (2) has an upper (2A) seal section and a lower (2B) seal section. A space between the upper seal section (2A) and the lower seal section (2B) may be in fluid communication with at least one port (10) in the pocket (7). The side pocket mandrel (3) may contain one or more fluid or gas injection ports (10) located between the seal sections (2A), (2B), where the ports (10) enable fluid or gas to injected into the pocket (7) from a hydraulic tube (9) that extends to the surface or subsea wellhead. The hydraulic tube (9) may be clamped externally on the production tubing (8). As may be inferred from the description of a method above, after sealant is released from within the dispenser (2), it may be pumped or flow by gravity into the ports (10) and then into the hydraulic tube (9). After the sealant has been moved into the tube (9), the wireline latch (6) may be operated to release the kickover tool (1), kickover arm (4) and wireline pulling or running tool (5) from the dispenser (2) so that the kickover tool (1), kickover arm (4) and wireline pulling or running tool (5) may be retrieved from the well. In other embodiments, the dispenser (2) may be retrieved with the kickover tool (1), kickover arm (4) and wireline pulling or running tool (5) after the sealant has cured.

Those skilled in the art will also appreciate that instead of a modified gas lift or chemical injection valve, a tube with seals dimensioned to enter and position correctly into the pocket (7) may be used to equal effect.

In some embodiments, the dispenser (2) may be positioned in the pocket (7) at a position above a gas lift valve, injection valve or similar device located in the pocket (7) for ordinary production operations. In such embodiments, the dispenser (2) may be actuated to release sealant above the gas lift valve, injection valve or similar device. The sealant may be allowed to cure and the dispenser (2) subsequently removed from the side pocket mandrel (3). Such embodiments may be used to seal the production tubing (8) in the event the gas lift valve, injection valve or similar device leaks. It will be appreciated by those skilled in the art that in such embodiments, the dispenser (2) may be operable to dispense sealant into the pocket (7) without the need to define a longitudinal space between spaced apart seals, such as the upper seal section (2A) and lower seal section (2B). In such embodiments, the dispenser (2) may be operable with only a single seal (e.g., upper seal section (2A)) to confine movement of sealant to within the pocket (7).

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A method for sealing a side pocket mandrel and hydraulic tube in a well, comprising:

moving a sealant dispenser into a pocket of the side pocket mandrel from within a well tubing, the sealant dispenser comprising an upper seal and a lower seal spaced apart therefrom and sealingly engaged with the pocket, a space between the upper seal and the lower seal in fluid communication with at least one port in the pocket, the pocket in fluid communication with a tube disposed externally to the side pocket mandrel and the tubing;

moving a curable sealant from the sealant dispenser into the pocket and into the tube; and at least one of allowing the sealant to cure and unlatching the sealant dispenser from a running tool used to move the sealant dispenser into the pocket.

2. The method of claim 1 further comprising removing the sealant dispenser and the running tool from the well.

3. The method of claim 1 wherein the removing the sealant dispenser comprises withdrawing a wireline conveyed kickoff tool and running tool from the well.

4. The method of claim 1 wherein the moving the sealant dispenser comprises lowering a wireline conveyed kickoff tool and running tool into the well.

5. A method for sealing a side pocket mandrel and hydraulic tube in a well, comprising:

moving a sealant dispenser into a pocket of the side pocket mandrel from within a well tubing, the sealant dispenser comprising a seal sealingly engaged with the pocket;

moving a curable sealant from the sealant dispenser into the pocket; and at least one of allowing the sealant to cure and unlatching the sealant dispenser from a running tool used to move the sealant dispenser into the pocket.

6. The method of claim 5 further comprising removing the sealant dispenser and the running tool from the well.

7. The method of claim 5 wherein the removing the sealant dispenser comprises withdrawing a wireline conveyed kickoff tool and running tool from the well.

8. The method of claim 5 wherein the moving the sealant dispenser comprises lowering a wireline conveyed kickoff tool and running tool into the well.

* * * * *